US006092465A

United States Patent [19]

Agronin

[11] Patent Number: 6,092,465

[45] Date of Patent: Jul. 25, 2000

[54] METHOD AND APPARATUS FOR PROVIDING ERASABLE RELIEF IMAGES

[75] Inventor: Michael L. Agronin, Owings Mills, Md.

[73] Assignee: United Container Machinery, Inc., Glen Arm, Md.

[21] Appl. No.: 09/034,183

[22] Filed: Mar. 3, 1998

[51] Int. Cl.[7] ..... B41N 1/00

[52] U.S. Cl. ..... 101/478

[58] Field of Search ..... 101/478, 368, 101/395, 401.1, 487, 488, 401

[56] References Cited

U.S. PATENT DOCUMENTS

| | | | |
|---|---|---|---|
| 3,455,239 | 7/1969 | Smith | 101/395 |
| 3,654,864 | 4/1972 | Ovshinsky | 101/478 |
| 3,819,783 | 6/1974 | Jones | 101/395 |
| 3,836,624 | 9/1974 | Ferris | 101/401.1 |
| 3,864,143 | 2/1975 | Fantazier et al. | 101/401.1 |
| 3,897,247 | 7/1975 | Schädlich et al. | 96/1.1 |
| 3,951,063 | 4/1976 | Schank | 101/466 |
| 4,064,205 | 12/1977 | Landsman | 101/401.1 |
| 4,268,615 | 5/1981 | Yonezawa | 101/401.1 |
| 4,859,094 | 8/1989 | Okada | 400/122 |
| 5,093,384 | 3/1992 | Hayashi et al. | 521/159 |
| 5,126,531 | 6/1992 | Majima et al. | 101/401.1 |
| 5,157,011 | 10/1992 | Okabe et al. | 503/201 |
| 5,173,381 | 12/1992 | Natansohn et al. | 430/19 |
| 5,188,033 | 2/1993 | Fadner | 101/467 |
| 5,189,110 | 2/1993 | Ikematu et al. | 525/314 |
| 5,233,921 | 8/1993 | John | 101/349 |
| 5,333,548 | 8/1994 | Fadner | 101/467 |
| 5,454,318 | 10/1995 | Hirt et al. | 101/453 |
| 5,538,822 | 7/1996 | Hotta et al. | 430/19 |
| 5,555,809 | 9/1996 | Hirt et al. | 101/451 |
| 5,635,319 | 6/1997 | Hotta et al. | 430/19 |

FOREIGN PATENT DOCUMENTS

| | | | |
|---|---|---|---|
| 59-207285 | 11/1984 | Japan | B41M 5/26 |
| 62-41091 | 2/1987 | Japan | B41N 1/06 |
| 2229089 | 9/1990 | Japan | B41N 1/12 |
| 361092 | 3/1991 | Japan | B41N 1/06 |
| 393597 | 4/1991 | Japan | B41N 1/04 |
| 3288684 | 12/1991 | Japan | B41L 15/06 |
| 7256852 | 10/1995 | Japan | B41C 1/055 |

OTHER PUBLICATIONS

B.K. Kim et al. "Polyurethanes having shape memory effects", *Polymer*, vol. 37 No. 26, 1996, pp. 5781–5793.

*Primary Examiner*—Ren Yan
*Assistant Examiner*—Amanda Sandusky
*Attorney, Agent, or Firm*—Biebel & French

[57] ABSTRACT

A method and apparatus for providing erasable relief images including providing a face surface formed of a temperature sensitive shape memory material. The face surface may be selectively heated to cause the shape memory material to displace and form a predetermined relief image. Alternatively, the shape memory material may be selectively engaged with die elements to form a predetermined relief image. The relief image may be erased by heating the face surface to thereby cause the shape memory material to return to a uniform surface contour, or to soften the shape material sufficiently for it to be engaged and compressed to a predetermined uniform configuration by an erasing element.

10 Claims, 8 Drawing Sheets

METHOD AND APPARATUS FOR PROVIDING ERASABLE RELIEF IMAGES

BACKGROUND OF THE INVENTION

The present invention relates to a method and apparatus for providing erasable relief images, and more particularly, to a method and apparatus for providing relief images which may be used in a printing process.

Printing processes, such as flexographic and gravure printing processes, are generally performed by a printing die which is coated with ink for a subsequent transfer to a substrate. For example, the printing die may be in the form of a rotating cylinder wherein the outer surface of the cylinder is formed of a hard material, such as metal, defining a relief image wherein the image is either defined by a raised relief portion, such as is used in flexographic printing, or by a predetermined grouping of cells for retaining ink to be transferred to the work piece, such as in gravure printing. Alternatively, in other applications, the die is in the form of a thick rubber mat that is strapped around a print drum.

In the past, it has generally been necessary to have a specific printing die, or dies, made up to print a particular pattern on a work piece, such that any pattern change requires that a new printing die be made up corresponding to the new pattern. The printing die is typically expensive and time-consuming to produce. Changing the printing die in a machine in order to change the printed pattern is also time consuming, with a resultant down time for the machine incorporating the die.

Accordingly, there is a need for a printing die which facilitates altering of the image printed by the die whereby the time and cost associated with changes in the printed image are reduced.

SUMMARY OF THE INVENTION

The present invention provides a method and apparatus for providing erasable relief images, and particularly provides an erasable printing die which may be incorporated into a conventional printing apparatus such as a flexographic or gravure printing press. Further, the present invention provides the ability to digitally load an image on demand to configure a printing die with a predetermined relief image for a printing process.

An apparatus for the present invention includes a die having a face surface defined by a temperature sensitive shape memory material, such as a shape memory polymer. The shape memory material is formed with a predetermined remembered configuration and at least portions of the shape memory material define a deformed configuration different from the remembered configuration. Heating means are provided for selectively heating predetermined areas of the face surface to cause the predetermined areas to move outwardly from the deformed configuration to the remembered configuration and thereby form a predetermined relief image. The predetermined relief image thus formed is subsequently exposed to ink for transfer of the predetermined image to a work piece.

The heating means preferably includes a heat source, such as a laser, for irradiating the predetermined areas of the face surface. Further, the predetermined areas of the face surface are preferably small discrete portions of the face surface, such as a plurality of discrete elements or dots located in close side-by-side relationship and compressed in the deformed configuration.

In addition, means for erasing an image from the face surface are also provided, the means for erasing including means for heating the face surface and for engaging and compressing the shape memory material from the remembered configuration to the deformed configuration.

In a method of the present invention, a face surface is defined by a shape memory material and the method includes the steps of compressing the face surface from a remembered configuration to a deformed configuration, and selectively heating predetermined areas of the face surface to cause the predetermined areas to move outwardly to the remembered configuration and thereby form a predetermined relief image.

In a further embodiment of the invention an apparatus is provided for forming erasable relief images wherein a face surface formed of a shape memory material is engaged by means for selectively deforming the face surface to produce a predetermined relief image. The face surface may be returned to a remembered configuration by heating the face surface. In addition, the face surface may be formed of a thin sheet of material adapted to be removed from a backing substrate whereby the sheet of material may be placed on a printing surface of a printing press.

Therefore, it is an object of the present invention to provide an apparatus for providing an erasable relief image.

It is a further object of the invention to provide an erasable relief image on a printing die.

It is yet another object of the invention to provide an erasable relief image by providing a shape memory material having discrete areas moveable between a deformed configuration and a remembered configuration to define the image.

It is another object of the invention to provide a method of forming an erasable relief image wherein portions of a shape memory material are caused to move to define a predetermined relief image through selective heating of predetermined areas of the face surface.

Other objects and advantages of the invention will be apparent from the following description, the accompanying drawings and the appended claims.

DETAILED DESCRIPTION OF THE PREFERRED EMBODIMENT

Figure 1A:
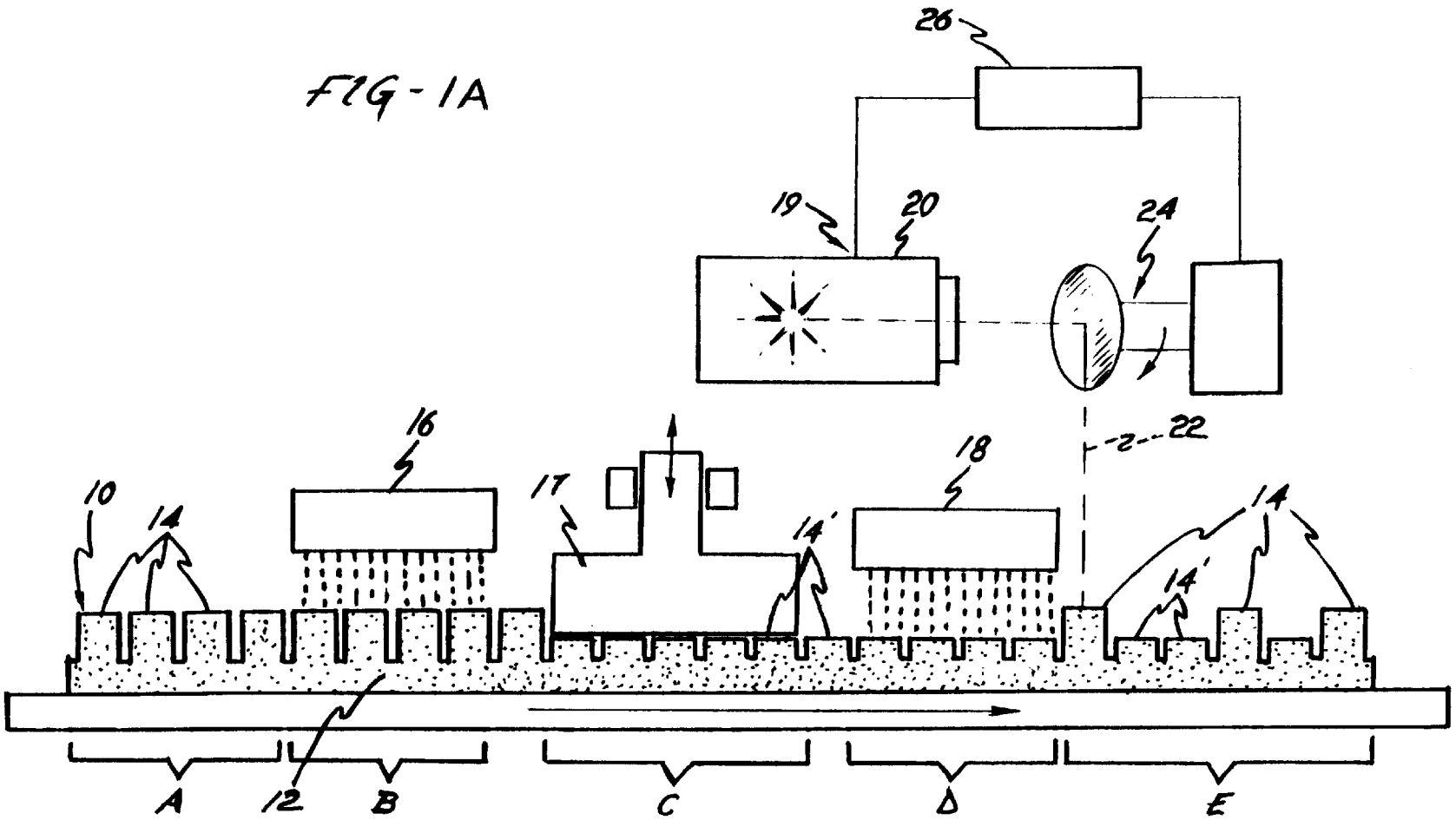
FIG. 1A is a side elevational view illustrating the method and apparatus of the present invention for forming erasable relief images.

Referring to FIG. 1A, the present invention provides a method and apparatus for providing erasable relief images which may be used in various applications, such as in a printing process or as a relief image for conveying information, for example as in a braille surface. The present invention provides a mechanism for producing a digitally generated pattern or image on a face surface wherein the face surface may be reused to print any number of different images.

Figure 2A:
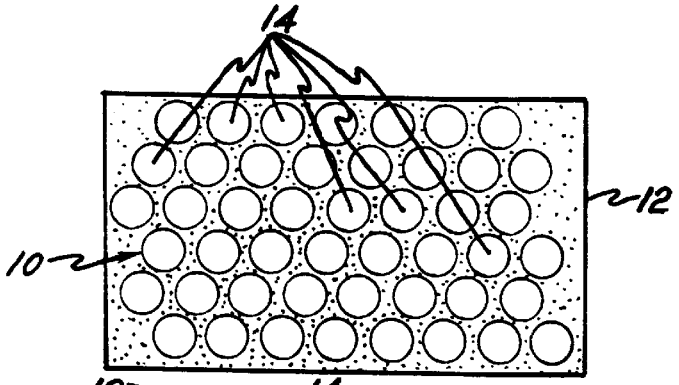
FIG. 2A is a plan view of a face surface formed of a shape memory material in accordance with the present invention.
Figure 2B:
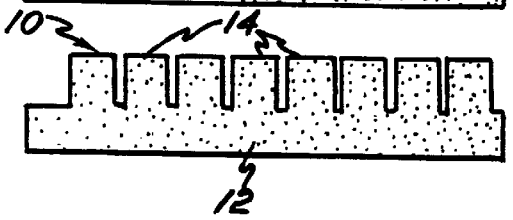
FIG. 2B is a side elevational view of the face surface of FIG. 2A.

The apparatus of the present invention includes a face surface 10 which, in the present embodiment, is defined by a shape memory polymer 12 including a plurality of raised elements or dots 14 (see also FIGS. 2A and 2B). The raised elements or dots 14 are formed with a remembered or normally raised configuration, and may be compressed to a deformed configuration 14'.

The shape memory polymer 12 may be of any conventional known shape memory material. For example, a shape memory material of the type disclosed in U.S. Pat. No. 5,189,110 may be used. The shape memory polymer 12 has a glass transition temperature at which the polymer will soften, and if previously deformed, will return to its remembered shape. In the process illustrated in FIG. 1A, the normally raised elements or dots 14 are shown at A and are conveyed from left to right to form a predetermined image. Initially, the elements 14 pass under a heat source 16 at B to heat the material 12 above its glass transition temperature. The material 12 is then compressed by a platen 17 at C to cause the elements 14 to be compressed from their remembered configuration (at A) to a deformed or erased configuration 14'. The elements 14' are conveyed past a cooling source 18 at D to remove heat from the material 12 such that the temperature of the material 12 is below its glass transition temperature whereby the elements 14' are maintained in their deformed configuration.

Subsequently, selected portions of the face surface 10 are heated above the glass transition temperature to cause those portions to rise to their remembered configuration and thereby define a predetermined relief image as shown at E. In order to selectively heat predetermined areas, or elements 14, of the face surface 10, a heat source 19, such as a laser 20 is provided emitting a laser beam 22 which is directed to the face surface 10 by a scanner mechanism 24. As seen in FIG. 1A, certain of the elements 14 are restored to their remembered configuration while other elements remain in the deformed configuration 14', such that a predetermined relief image is defined on the face surface 10. The formation of the predetermined image may be digitally controlled by a programmable controller 26 for controlling the laser 20 and scanner 24, as well as movement of the face surface 10 through the apparatus.

As illustrated in FIGS. 2A and 2B, the shape memory polymer material 12 may be initially formed with a uniform raised dot pattern wherein the size and spacing of the dots is determined by the image resolution desired. In addition, in the compressed or deformed state 14' the elements 14 also define a uniform or flat configuration or surface when uniformly compressed by the platen 17.

Figure 1B:
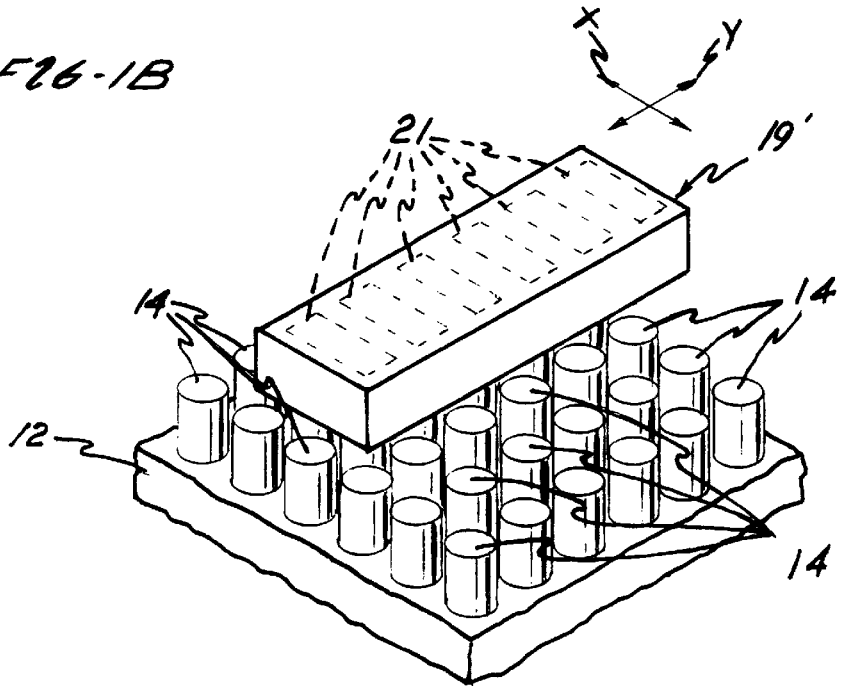
FIG. 1B illustrates an alternative heat source for the apparatus of FIG. 1A.

Referring to FIG. 1B, an alternative heat source 19' is illustrated for selectively heating predetermined ones of the elements 14 to form a desired image. The heat source 19' comprises an array of elements 21 defining individual infrared sources. The elements 21 may comprise an array of selectively controlled lights, or alternatively, may comprise hot wires. The elements 21 may further comprise individual laser diodes. Also, the heat source may be supported for movement in the X and Y directions to facilitate placement of the elements at precise locations. In addition, it should be noted that any number of rows of the elements 21 may be provided, and the size of the elements 21 may be selected depending on the size and spacing of the raised elements 14.

Figure 3:
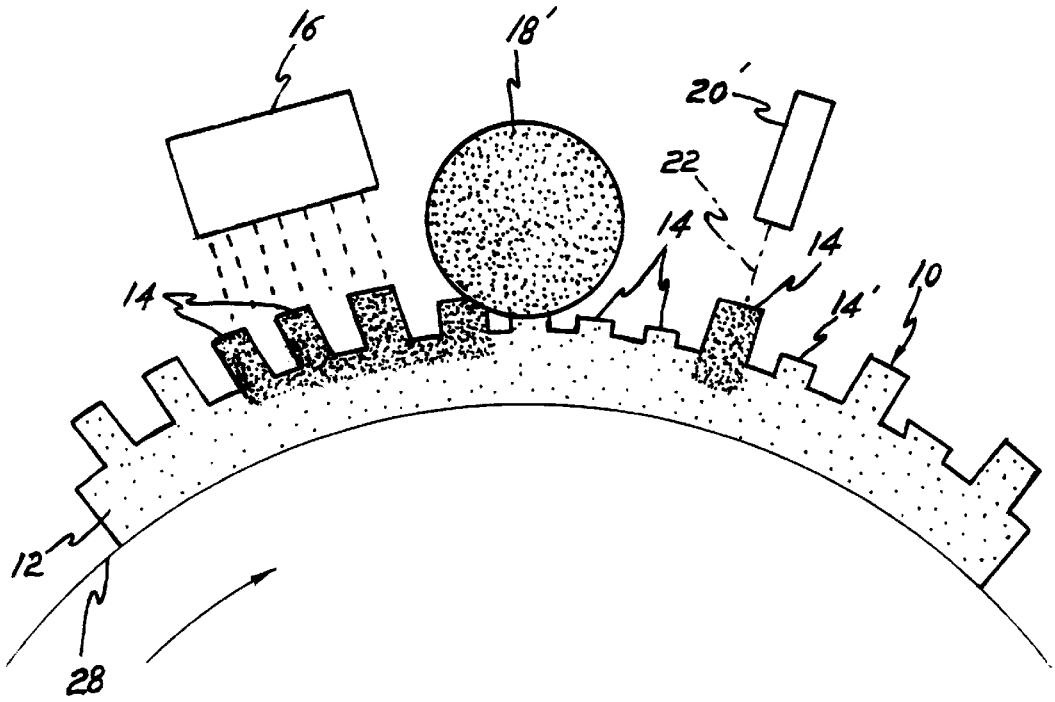
FIG. 3 is a partial side elevational view illustrating the present invention incorporated in a flexographic printing process.

Referring to FIG. 3, the present invention is shown incorporated into a flexographic printing process including a cylindrical printing die 28 carrying the shape memory polymer 12. In the apparatus illustrated, a heat source 16, such as a radiant heater, is provided to heat the material 12 to its glass transition temperature and a cooling roll 18' is provided for both compressing and cooling the elements 14 to their deformed configuration 14'. A laser scanner mechanism 20' scans to predetermined locations on the face surface 10 to cause preselected ones of the deformed elements 14' to be heated and reconfigured to their remembered configuration 14 whereby a predetermined image is defined on the die. It should be noted that in a further variation of the present invention, the heating and compressing operations could be performed in a single operation, such as by providing a heated roll in the embodiment of FIG. 3, or a heated platen in the embodiment of FIG. 1A.

Figure 4:
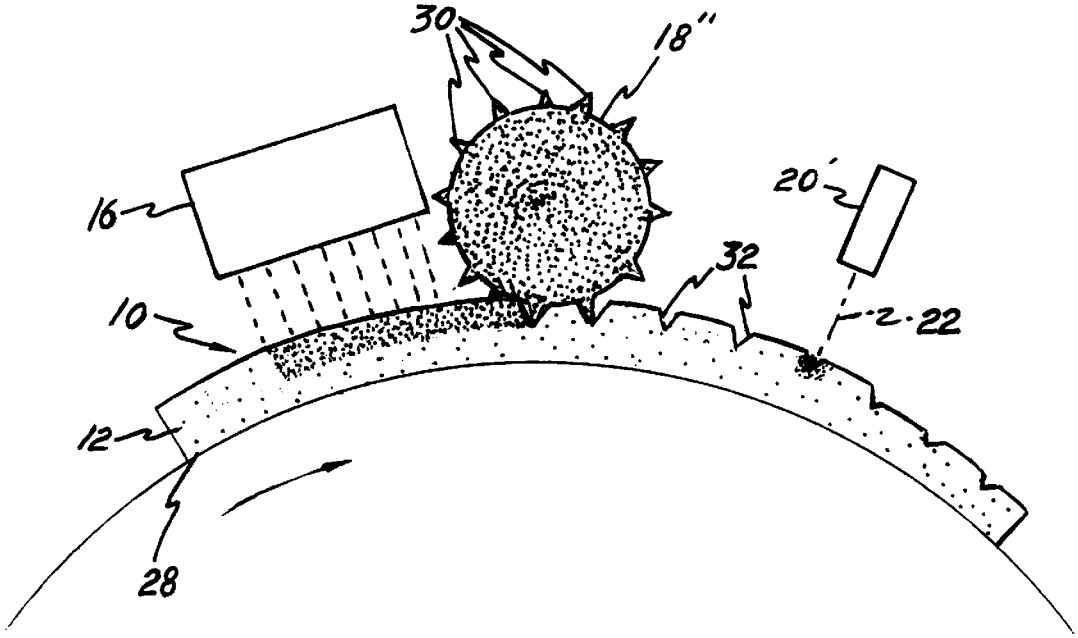
FIG. 4 is a partial side elevational view showing the present invention incorporated in a gravure printing process.

Referring to FIG. 4, the present invention is shown incorporated into a gravure printing process including a cylindrical gravure die 28 carrying the shape memory material 12 wherein the material 12 is initially heated by a heater 16, and a cooling roll 18" is provided including a plurality of projections 30 for compressing discrete areas of the face surface 10 to define a plurality of cells 32 wherein the plurality of cells 32 are spaced both longitudinally and circumferentially along the die 28. The laser scanner 20' selectively scans predetermined cells 32 to cause the cells to move upwardly or flatten to the upper level of the remembered surface 10. Accordingly, the remaining cells 32 define a relief image for receiving ink to be transferred to a printing surface. In addition, when it is desired to provide a different relief image on the die 28, the heating means 16' is activated to irradiate the surface 10 and thereby cause all of the cells 32 to return to the remembered or flat configuration in preparation for the cooling roll 18" to again deform the surface 10 to provide a uniform array of cells 32.

Figure 5:
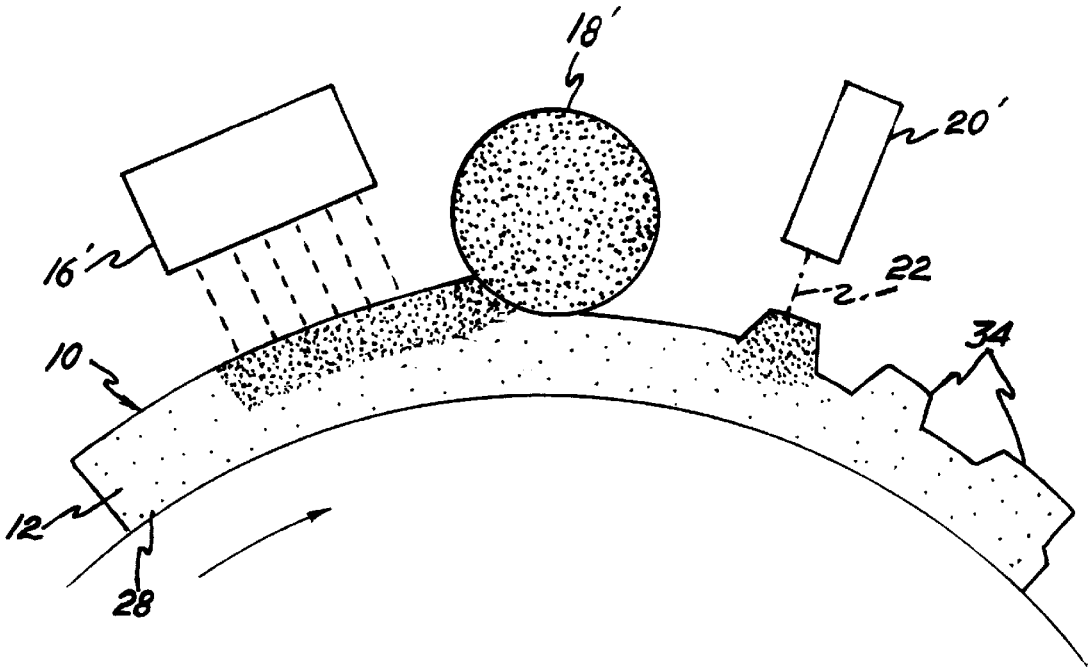
FIG. 5 is a partial side elevational view illustrating the use of a shape memory foam material incorporated on a printing die.

Referring to FIG. 5, the present invention is illustrated incorporated on a printing die 28 for flexographic printing wherein the shape memory material 12 comprises a shape memory foam. The foam material's remembered configuration would be raised and substantially flat, and a cooling roll 18' is provided to flatten and compress the foam material 12 downwardly after the face surface 10 is heated by the heating means 16'. The laser scanner 20' is provided to heat the foam material 12 and cause continuous sections of it to rise whereby a continuous pattern or solid print area 34 is defined. Accordingly, a shape memory foam may be used in applications where high resolution printing is not required and large solid print areas are desired.

Figure 6A:
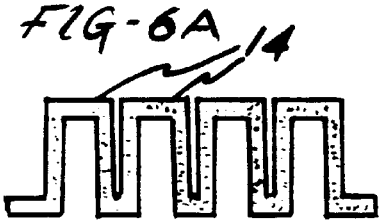
FIG. 6A illustrates a plurality of hollow raised elements for forming a face surface for the present invention.
Figure 6B:
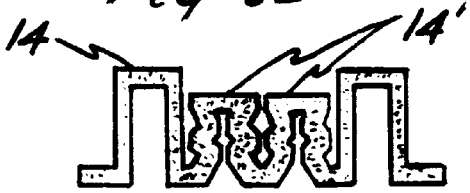
FIG. 6B illustrates the elements of FIG. 6A in a deformed or compressed configuration.

Referring to FIGS. 6A and 6B, an alternative configuration for the raised elements 14 is illustrated wherein the raised elements 14 may be configured as hollow raised dots or cylindrical protrusions formed of the shape memory material. As seen in FIG. 6B, the hollow elements 14 permit the material forming the sides of the elements 14 to compress inwardly and thereby permit material flow when in the deformed or compressed configuration 14'. Thus, the hollow elements 14 require less force to flatten during the erasing portion of the image forming process. Further, it should be noted that the elements could be formed of a material containing a plurality of bubbles, such as shape memory foam, to enhance their compressibility. In the event that elements 14 are formed of shape memory foam, the upper portion of the elements 14 could be covered with a smooth surface material to improve printability.

Figure 7A:
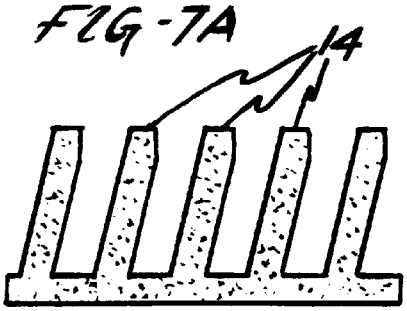
FIG. 7A illustrates an alternative configuration for the raised elements.
Figure 7B:
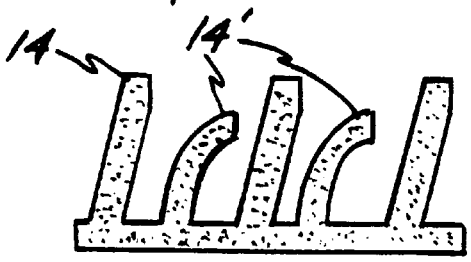
FIG. 7B illustrates the elements of FIG. 7A in a deformed or compressed configuration.

Referring to FIGS. 7A and 7B, the elements 14 are defined by angled elements to reduce the vertical stiffness of the elements 14 wherein a vertical load will cause the elements to bend, as illustrated by elements 14' in FIG. 7B. This configuration of the elements 14 will reduce the stiffness both for image formation and erasing.

Figure 8A:
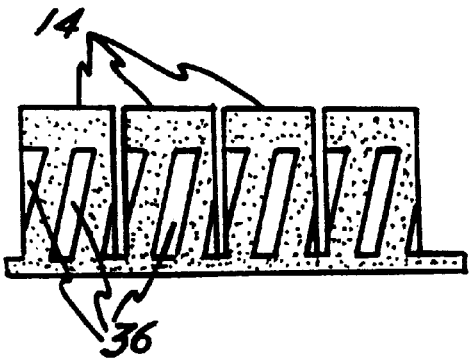
FIG. 8A illustrates a further alternative configuration for the raised elements.
Figure 8B:
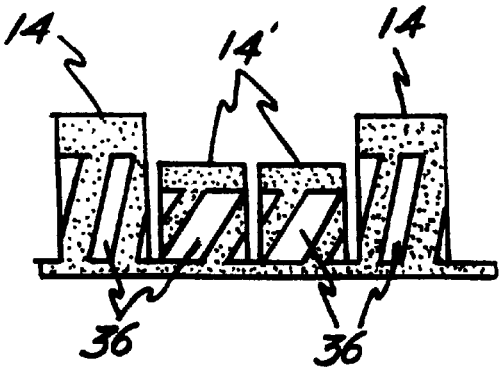
FIG. 8B illustrates a deformed or compressed configuration for the elements of FIG. 8A.

Referring to FIGS. 8A and 8B, the elements 14 are formed as hollow raised dots having a plurality of angled slots 36 defined in the vertical walls thereof. When the elements 14 are moved to the compressed configuration 14', the slots will cause the elements 14 to twist as they flatten to thereby limit outward displacement of material and permit closer spacing between the elements 14.

Figure 9A:
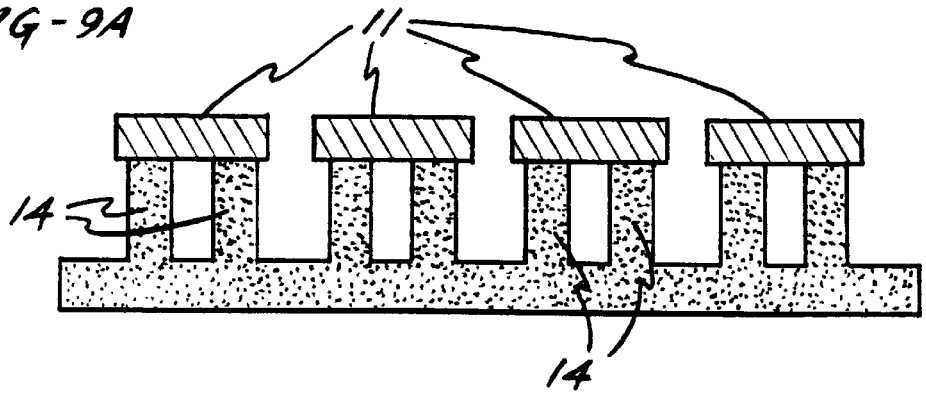
FIG. 9A illustrates another alternative configuration for the raised elements.
Figure 9B:
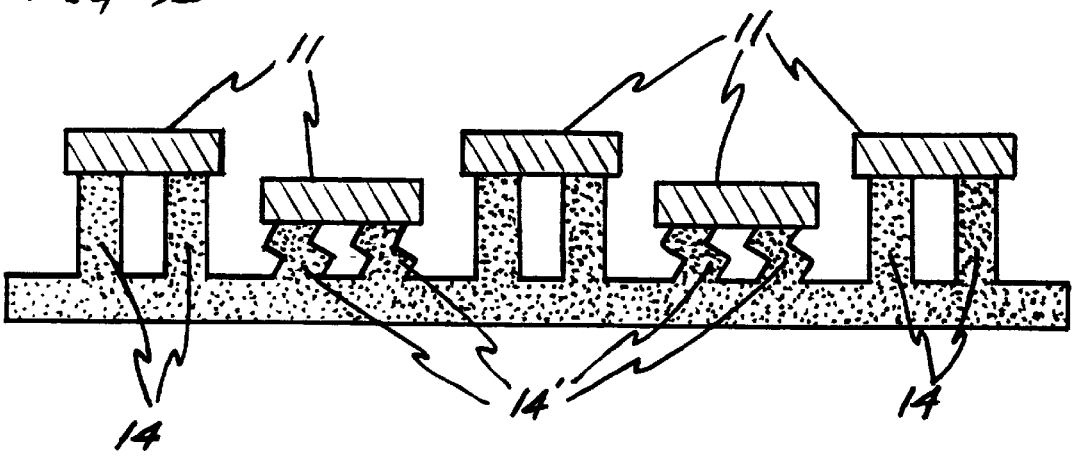
FIG. 9B illustrates the elements of FIG. 9A in a deformed or compressed configuration.

Referring to FIGS. 9A and 9B, the elements 14 are formed as legs supporting a printing surface element 11 wherein the printing surface element 11 may be formed of any material suitable for printing. The legs 14 are formed of a shape memory material, such as a polymer, and alternatively may be formed of a shape memory metal, wherein the legs collapse or buckle when compressed, as illustrated by elements 14' in FIG. 9B. The buckling of the legs 14 allows the surface elements 11 to displace downwardly while limiting outward displacement of the material forming the legs 14.

Figure 10:
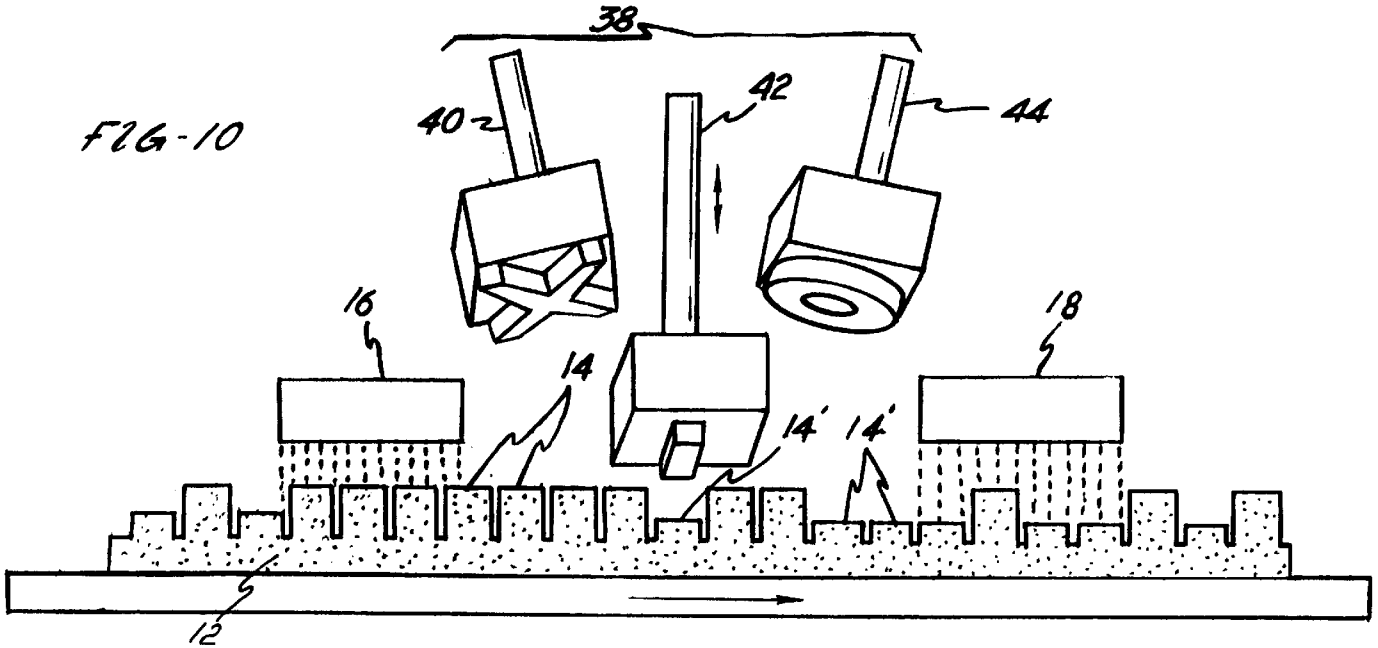
FIG. 10 is a side elevational view illustrating a further embodiment of the method and apparatus of the present invention.

Referring to FIG. 10, a further embodiment of the invention is illustrated for operating on the previously described shape memory polymer material 12. The shape memory polymer shown in FIG. 10 is conveyed in a direction from left to right and, as in the embodiment of FIG. 1A, a heat source 16 is provided to heat the material 12 above its glass transition temperature whereby any previous impressions left in the material 12 are erased.

With the material 12 at or above its glass transition temperature, it is conveyed beneath an array 38 of predetermined relief image dies, as diagrammatically illustrated by the dies 40, 42, 44, and may comprise any number of dies. The die array 38 is selectively actuated, as illustrated by die 42, to engage the material 12 to thereby selectively deform the elements 14 to a desired predetermined configuration 14'. The material is then cooled below its glass transition temperature by the cooling source 18.

It should be noted that the array 38 may comprise any kind of mechanical impressing device for forming predetermined images in the material 12. For example, a dot matrix print head may also be utilized wherein the pins on the print head array would correspond in spacing and size to the dot array on the plate comprising the elements 14. Alternatively, a mechanism resembling a typewriter mechanism may be incorporated such that a series of letters or other characters could be typed onto the material 12. Further, it should be understood that the image impressed in the material 12 could be a negative image, such that lowered or deformed portions do not print, for flexographic printing, or a positive image, such that lowered or deformed portions print, for gravure printing.

Figure 11:
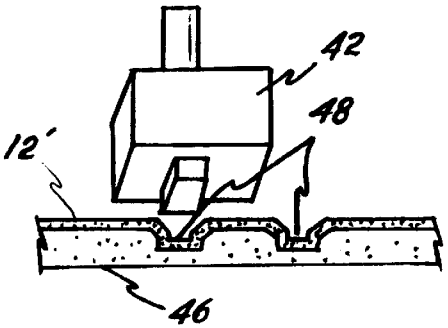
FIG. 11 is a side elevational view of the method and apparatus in accordance with FIG. 10 operating on a shape memory material formed of a thin sheet of material to form predetermined images for gravure printing.
Figure 12:
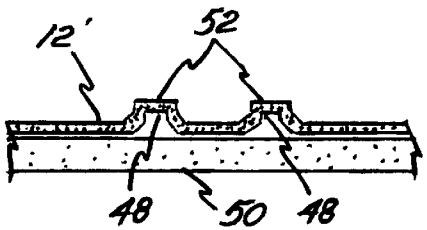
FIG. 12 illustrates an alternative use of the image formed in FIG. 11 mounted for flexographic printing.

Referring to FIG. 11, an alternative face surface 12' is illustrated for use with the embodiment of FIG. 10 wherein the face surface 12' comprises a thin sheet or film of shape memory polymer material supported by a compressible substrate material 46 such as a foam elastomer. The shape memory film 12' is initially heated to its glass transition temperature, for example by passing it under heat source 16, and images are then formed by engaging elements from the array 38 on the thin film face surface 12', as illustrated by die element 42. The image formed on the film 12', as illustrated in FIG. 11, may be used for gravure printing wherein cells 48 formed through engagement by the array 38 define a predetermined image to be printed.

Alternatively, the thin film face surface 12' may be detached from the substrate 46 and flipped over and attached to a backing substrate 50, such as a compliant backing on a printing device. In this use of the face surface 12' the impressed images 48 now define predetermined raised relief images 52 suitable for flexographic printing.

It should be noted that the write and erase structures for performing the present invention could be built directly into a printing press and act on a die mounted to a print drum. Alternatively, the write and erase structure could be provided on a separate machine such that the erasable dies could be used on a conventional press without requiring modification of the press. In addition, different shapes of the elements 14 may be provided for different classes of printed patterns. For example, an array of closely spaced horizontal bars could be used for printing bar codes. Further, the elements 14 could be formed as dots of any size, shape or spacing suitable for the desired printed image.

It should be noted that any number of means for heating the elements of the shape memory polymer may be provided. For example, conduction through the die drum, conduction through a heated nip, conduction using a heated fluid or gas, or radiation using an infrared source.

Further, the die could be coated with a thin layer of non-shape memory material to enhance printability. For instance, a gravure die could be coated with a substance to better resist ink, or the material of a flexographic die could include dot tips which are coated with a harder or softer elastomer to control the overall stiffness of the dot.

While the methods and forms of apparatus herein described constitute preferred embodiments of this invention, it is to be understood that the invention is not limited to these precise methods or forms of apparatus, and that changes may be made therein without departing from the scope of the invention which is defined in the appended claims.

What is claimed is:

1. An apparatus for providing erasable relief images comprising:

a face surface defining a substantially uniform surface;

means for selectively reshaping said face surface to produce a predetermined relief image;

means for reconfiguring said face surface to said substantially uniform surface; and wherein said means for selectively reshaping said face surface comprises elements defining predetermined raised characters for engagement with said face surface to selectively deform said face surface in the shape of said raised characters.

2. The apparatus of claim 1 wherein said face surface is defined by a thin sheet of material.

3. The apparatus of claim 2 wherein said thin sheet of material comprises a temperature sensitive shape memory material.

4. The apparatus of claim 1 wherein said means for reconfiguring said face surface to said substantially uniform surface comprises means for heating said face surface.

5. An apparatus for providing erasable relief images comprising:

a plurality of discrete raised elements formed of a shape memory material and having upper portions defining a substantially uniform remembered surface;

means for engaging said raised elements to position said upper portions at a deformed position where said upper portions are at a generally uniform level;

heating means for selectively heating predetermined ones of said raised elements to cause said predetermined ones of the raised elements to move upwardly to the level of said remembered surface; and wherein said raised elements include side portions supporting said upper portions, and said side portions defining compressible elements whereby compression of said raised elements is facilitated.

6. The apparatus of claim 5 wherein said raised elements comprise a shape memory foam material.

7.The apparatus of claim 5 wherein said side portions define a hollow interior space beneath said upper portions.

8. The apparatus of claim 7 including slots extending along said side portions.

9. The apparatus of claim 5 wherein said side portions comprise a plurality of spaced legs supporting each of said upper portions.

10. The apparatus of claim 5 wherein said raised elements are closely spaced and said side portions compress inwardly a greater amount than outward expansion during downward movement of said upper portion.

* * * * *